US011251029B2

(12) United States Patent
Baba et al.

(10) Patent No.: US 11,251,029 B2
(45) Date of Patent: Feb. 15, 2022

(54) METHOD FOR TOP DOWN PROTEOMICS USING EXD AND PTR

(71) Applicant: DH TECHNOLOGIES DEVELOPMENT PTE. LTD., Singapore (SG)

(72) Inventors: Takashi Baba, Richmond Hill (CA); Pavel Ryumin, Toronto (CA); William M. Loyd, Sugar Land, TX (US)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 17/255,607

(22) PCT Filed: Aug. 15, 2019

(86) PCT No.: PCT/IB2019/056936
§ 371 (c)(1),
(2) Date: Dec. 23, 2020

(87) PCT Pub. No.: WO2020/044160
PCT Pub. Date: Mar. 5, 2020

(65) Prior Publication Data

US 2021/0257200 A1 Aug. 19, 2021

Related U.S. Application Data

(60) Provisional application No. 62/724,497, filed on Aug. 29, 2018.

(51) Int. Cl.
*H01J 49/00* (2006.01)
*H01J 3/40* (2006.01)
(Continued)

(52) U.S. Cl.
CPC ..... *H01J 49/0031* (2013.01); *H01J 3/40* (2013.01); *H01J 29/84* (2013.01);
(Continued)

(58) Field of Classification Search
CPC ..... H01J 49/0031; H01J 49/0036; H01J 49/0072; H01J 49/0054; H01J 49/0059; H01J 49/062; H01J 3/40; H01J 29/84
(Continued)

(56) References Cited

U.S. PATENT DOCUMENTS

2007/0164212 A1 7/2007 Ogata et al.
2017/0117124 A1 4/2017 Baba et al.
(Continued)

FOREIGN PATENT DOCUMENTS

EP 2388798 B1 8/2016
JP 5928597 B2 6/2016
WO 2017-221151 A1 12/2017

OTHER PUBLICATIONS

International Search Report and Written Opinion for PCT/IB2019/056936, dated Jan. 15, 2020.

*Primary Examiner* — Kiet T Nguyen
(74) *Attorney, Agent, or Firm* — Kasha Law LLC; John R. Kasha; Kelly L. Kasha

(57) ABSTRACT

A dissociation device fragments a precursor ion, producing at least two different product ions with overlapping m/z values in the dissociation device. The dissociation device applies an AC voltage and a DC voltage creating a pseudo-potential that traps ions below a threshold m/z including the at least two product ions. The dissociation device receives a charge reducing reagent that causes the trapped at least two product ions to be charge reduced until their m/z values increase above the threshold m/z set by the AC voltage. The increase in the m/z values of the at least two product ions decreases their overlap. The at least two product ions with increased m/z values are transmitted to another device for subsequent mass analysis by applying the DC voltage to the dissociation device relative to a DC voltage applied to the other device.

15 Claims, 10 Drawing Sheets

(51) Int. Cl.
*H01J 29/84* (2006.01)
*H01J 49/06* (2006.01)

(52) U.S. Cl.
CPC ..... *H01J 49/0036* (2013.01); *H01J 49/0054* (2013.01); *H01J 49/0059* (2013.01); *H01J 49/0072* (2013.01); *H01J 49/062* (2013.01)

(58) Field of Classification Search
USPC ..... 250/281, 282
See application file for complete search history.

(56) References Cited

U.S. PATENT DOCUMENTS

2017/0162372 A1* 6/2017 Stephenson, Jr. ... H01J 49/0445
2019/0378703 A1* 12/2019 Baba ..... H01J 49/063

* cited by examiner

100

500

| | 21 | 20 | 19 | 18 | 17 | 16 | 15 | 14 | 13 | 12 | 11 | 10 |
|---|---|---|---|---|---|---|---|---|---|---|---|---|
| | 17000 | 16190.48 | 15380.95 | 14571.43 | 13761.9 | 12952.38 | 12142.86 | 11333.33 | 10523.81 | 9714.286 | 8904.762 | 8095.238 |
| 21 | [illegible] | | | | | | | | | | | |
| 20 | 850 | [illegible] | | | | | | | | | | |
| 19 | 894.7368 | 852.1303 | [illegible] | | | | | | | | | |
| 18 | 944.4444 | 899.4709 | 854.4974 | [illegible] | | | | | | | | |
| 17 | 1000 | 952.381 | 904.7619 | 857.1429 | [illegible] | | | | | | | |
| 16 | 1062.5 | 1011.905 | 961.3095 | 910.7143 | 860.119 | [illegible] | | | | | | |
| 15 | 1133.333 | 1079.365 | 1025.397 | 971.4286 | 917.4603 | 863.4921 | [illegible] | | | | | |
| 14 | 1214.286 | 1156.463 | 1098.639 | 1040.816 | 982.9932 | 925.1701 | 867.3469 | [illegible] | | | | |
| 13 | 1307.692 | 1245.421 | 1183.15 | 1120.879 | 1058.608 | 996.337 | 934.0659 | 871.7949 | [illegible] | | | |
| 12 | 1416.667 | 1349.206 | 1281.746 | 1214.286 | 1146.825 | 1079.365 | 1011.905 | 944.4444 | 876.9841 | [illegible] | | |
| 11 | 1545.455 | 1471.861 | 1398.268 | 1324.675 | 1251.082 | 1177.489 | 1103.896 | 1030.303 | 956.71 | 883.1169 | [illegible] | |
| 10 | 1700 | 1619.048 | 1538.095 | 1457.143 | 1376.19 | 1295.238 | 1214.286 | 1133.333 | 1052.381 | 971.4286 | 890.4762 | [illegible] |
| 9 | 1888.889 | 1798.942 | 1708.995 | 1619.048 | 1529.101 | 1439.153 | 1349.206 | 1259.259 | 1169.312 | 1079.365 | 989.418 | 899.4709 |
| 8 | 2125 | 2023.81 | 1922.619 | 1821.429 | 1720.238 | 1619.048 | 1517.857 | 1416.667 | 1315.476 | 1214.286 | 1113.095 | 1011.905 |
| 7 | 2428.571 | 2312.925 | 2197.279 | 2081.633 | 1965.986 | 1850.34 | 1734.694 | 1619.048 | 1503.401 | 1387.755 | 1272.109 | 1156.463 |
| 6 | 2833.333 | 2698.413 | 2563.492 | 2428.571 | 2293.651 | 2158.73 | 2023.81 | 1888.889 | 1753.968 | 1619.048 | 1484.127 | 1349.206 |
| 5 | 3400 | 3238.095 | 3076.19 | 2914.286 | 2752.381 | 2590.476 | 2428.571 | 2266.667 | 2104.762 | 1942.857 | 1780.952 | 1619.048 |
| 4 | 4250 | 4047.619 | 3845.238 | 3642.857 | 3440.476 | 3238.095 | 3035.714 | 2833.333 | 2630.952 | 2428.571 | 2226.19 | 2023.81 |
| 3 | 5666.667 | 5396.825 | 5126.984 | 4857.143 | 4587.302 | 4317.46 | 4047.619 | 3777.778 | 3507.937 | 3238.095 | 2968.254 | 2698.413 |
| 2 | 8500 | 8095.238 | 7690.476 | 7285.714 | 6880.952 | 6476.19 | 6071.429 | 5666.667 | 5261.905 | 4857.143 | 4452.381 | 4047.619 |
| 1 | 17000 | 16190.48 | 15380.95 | 14571.43 | 13761.9 | 12952.38 | 12142.86 | 11333.33 | 10523.81 | 9714.286 | 8904.762 | 8095.238 |

601 602 600 607 612

FIG. 6

METHOD FOR TOP DOWN PROTEOMICS USING EXD AND PTR

RELATED APPLICATIONS

This application claims the benefit of U.S. Provisional Patent Application Ser. No. 62/724,497, filed on Aug. 29, 2018, the content of which is incorporated by reference herein in its entirety.

INTRODUCTION

The teachings herein relate to mass spectrometry apparatus for reducing the charge of at least two product ions in order to move the mass-to-charge ratio (m/z) values of the at least two product ions above a threshold m/z value and decrease overlap among the m/z values of the at least two product ions before mass analysis. More specifically, a dissociation device fragments a precursor ion, traps product ions below a threshold m/z value using a pseudopotential created by an alternating current (AC) voltage and a direct current (DC) voltage, receives a charge reducing reagent that causes the trapped product ions to be charge reduced so that the m/z values of at least two product ions increase above the threshold m/z, thereby decreasing m/z overlap, and transmits the at least two product ions to another device for subsequent mass analysis by applying a direct current (DC) voltage relative to the other device.

The apparatus and methods disclosed herein are also performed in conjunction with a processor, controller, microcontroller, or computer system, such as the computer system of FIG. 1.

Mass Spectrometry Background

Mass spectrometry (MS) is an analytical technique for detection and quantitation of chemical compounds based on the analysis of m/z values of ions formed from those compounds. MS involves ionization of one or more compounds of interest from a sample, producing precursor ions, and mass analysis of the precursor ions.

Tandem mass spectrometry or mass spectrometry/mass spectrometry (MS/MS) involves ionization of one or more compounds of interest from a sample, selection of one or more precursor ions of the one or more compounds, fragmentation of the one or more precursor ions into product ions, and mass analysis of the product ions.

Both MS and MS/MS can provide qualitative and quantitative information. The measured precursor or product ion spectrum can be used to identify a molecule of interest. The intensities of precursor ions and product ions can also be used to quantitate the amount of the compound present in a sample.

Fragmentation Techniques Background

Electron-based dissociation (ExD), ultraviolet photodissociation (UVPD), infrared photodissociation (IRMPD) and collision-induced dissociation (CID) are often used as fragmentation techniques for tandem mass spectrometry (MS/MS). ExD can include, but is not limited to, electron capture dissociation (ECD) or electron transfer dissociation (ETD). CID is the most conventional technique for dissociation in tandem mass spectrometers.

Product Ion Overlap Problem

In top down and middle down proteomics, an intact or digested protein is ionized and subjected to tandem mass spectrometry. ECD, for example, is a dissociation technique that dissociates peptide and protein backbones preferentially. As a result, this technique is an ideal tool to analyze peptide or protein sequences using a top-down and middle down proteomics approach. Unfortunately, however, a large degree of product ion overlap has been encountered in some ECD protein analysis. In particular, it has been demonstrated that product ions produced by ECD with high charge states (>15+) and with m/z values very close to their precursor ions can have m/z values that overlap with each other. Because these different product ions have almost the same m/z values, they are difficult (or almost impossible) to detect mass selectively.

FIG. 2 is an exemplary hypothetical plot 200 of a product ion mass spectrum for a protein showing a region of overlapped highly charged product ions near their precursor ion. For example, bracket 210 shows a region of overlapped highly charged product ions near their precursor ion 220.

One method of reducing the m/z overlap of ions is to reduce their charge. Reducing the charge of an ion increases its m/z value. Reducing the charge of two ions with similar m/z values can move these ions to higher m/z values that have little or no overlap.

McLuckey et al., Anal. Chem. 2002, 74, 336-346, (hereinafter the "McLuckey Paper"), fix example, describes that it is well known that the ion charge associated with high-mass multiply charged ions can be manipulated. It is also known that accumulated ions can be mixed with ions of the opposite charge producing an ion/ion proton-transfer reaction (PTR) to also reduce the charge state of the ions.

Others have applied PTR to the product ions produced by ETD to move the m/z values of the product ions, prevent product ion overlap, and simplify the product ion spectrum (www.pnas.org/cgi/doi/10.1073/pnas.0503189102 PNAS 2005 vol. 102 page 9463-946). However, in these studies, some large fragments have been lost because such charge reduced fragments (with very large m/z) were moved out of the mass range of the mass analyzer used.

The McLuckey Paper provides one method of limiting the PTR applied to ions to a specific m/z value. In this technique, the rate of an ion/ion PTR is inhibited in a selective fashion such that only particular ions are mantained in the trap. The McLuckey Paper refers to this inhibition of an ion/ion PTR as "peak parking." In order to inhibit an ion/ion PTR, the technique of the McLuckey Paper applies a dipolar resonance excitation voltage to the endcap electrodes of a quadrupole ion trap. An exemplary resonance excitation voltage described in the McLuckey Paper has a frequency on the order of tens of thousands of Hertz.

The resonance excitation AC voltage is applied at the secular frequency of a target ion peak at pre-set charge state to excite the species; then a PTR is applied to the group of ions with many charge states. Because the PTR reaction rate is decreased by the high kinetic energy of the ions, PTR is stopped when the ion charge states or m/z reach the exciting target.

Unfortunately, this approach has not been implemented in commercial instruments because of the complex parameter settings that are needed. Another problem with this approach is that the resonance excitation of the ions is very likely to cause the ions to lose fragile post-translational modification moieties, such as glycosylation. In other words, the resonance excitation of ions can cause the ions to fragment. Still another problem with this approach is that it involves a pulsed release of the parked ions. Charge reduced ions remain in the trap. They are then released all at once from the trap for selection and analysis. This pulsed release means that a large number of ions may be released at once. The release of a large number of ions at one time can lead to the saturation of a downstream mass analyzer.

SUMMARY

An apparatus, method, and computer program product are disclosed for reducing the charge of at least two product ions in order to move the m/z values of the at least two product ions above a threshold m/z value and decrease overlap among the m/z values of the at least two product ions before mass analysis. The apparatus includes a dissociation device and a PTR reagent source device.

The reagent source device supplies charge reducing reagent. The dissociation device receives a precursor ion and fragments the precursor ion, producing a plurality of product ions. The dissociation device receives the charge reducing reagent from the reagent source device. The dissociation device applies an AC voltage and a DC voltage to its one or more electrodes that creates a pseudopotential in the axial direction to trap product ions of the plurality of product ions with m/z values below a threshold m/z in the dissociation device. The AC voltage, in turn, causes the trapped product ions to be charge reduced by the received charge reducing reagent so that m/z values of at least two product ions of the trapped product ions increase to m/z values above the threshold m/z. The dissociation device applies the DC voltage to its one or more electrodes relative to a DC voltage applied to electrodes of a next device positioned after the dissociation device that causes the at least two product ions with m/z values increased above the threshold m/z to be continuously transmitted to the next device.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

FIG. 6 an exemplary hypothetical table showing hypothetically the m/z values for 12 different product ions of myoglobin at difference charge states, in accordance with various embodiments.

Figure 1:
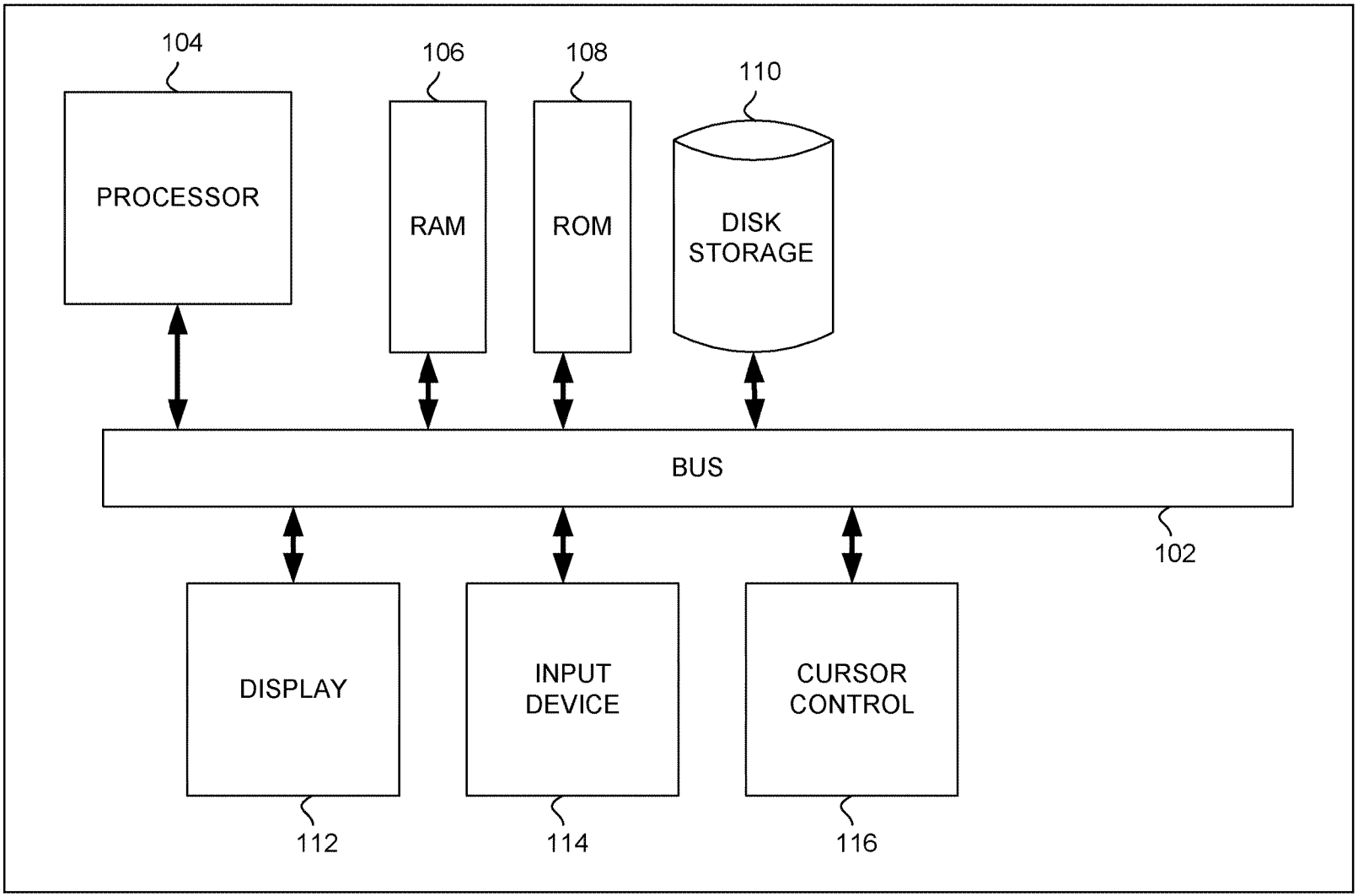
FIG. 1 is a block diagram that illustrates a computer system, upon which embodiments of the present teachings may be implemented.
Figure 2:
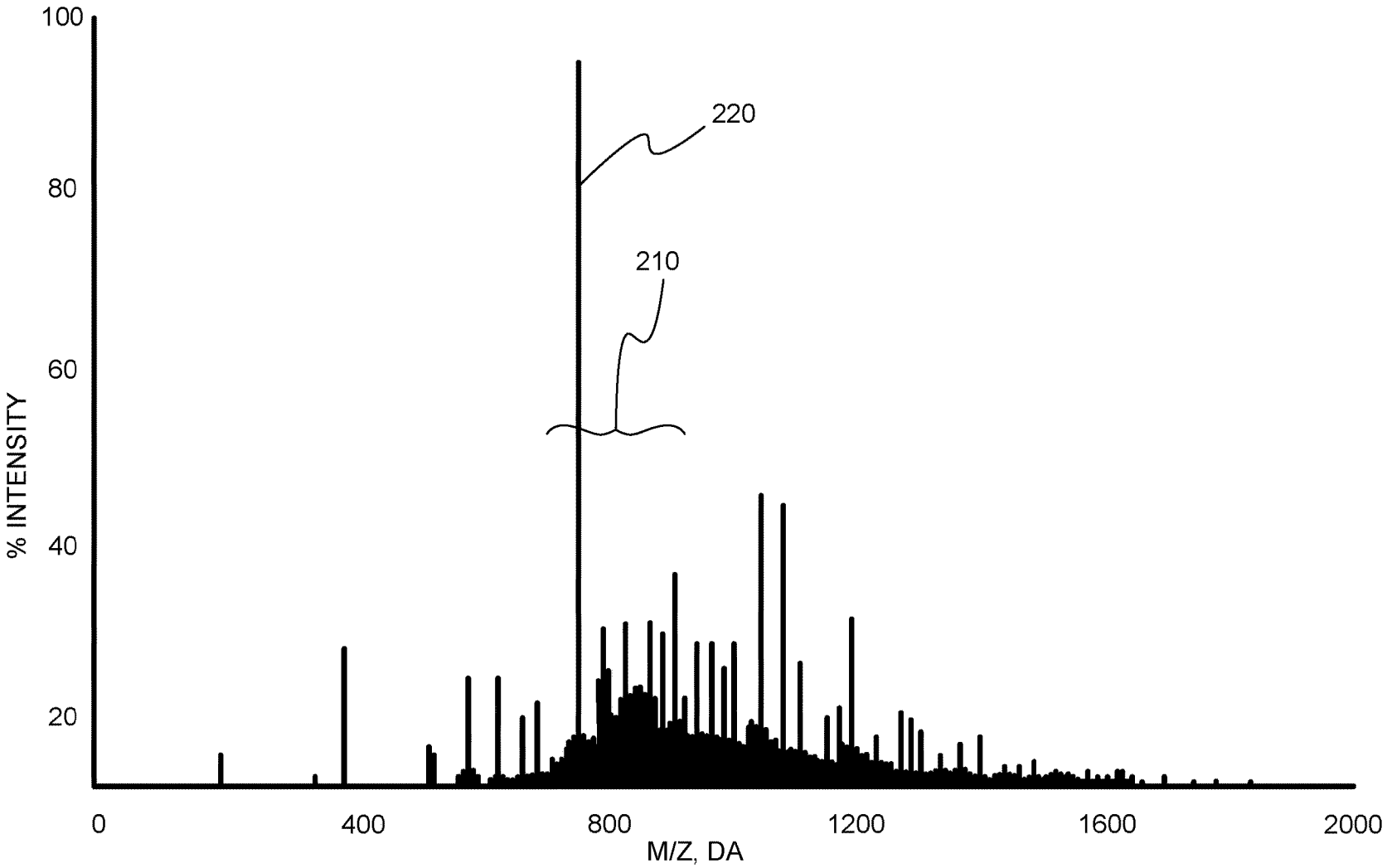
FIG. 2 is an exemplary hypothetical plot of a product ion mass spectrum for a protein showing a region of overlapped highly charged product ions near their precursor ion.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively, hard-wired circuitry may be used in place of or in combination with software instructions to implement the present teachings. Thus implementations of the present teachings are not limited to any specific combination of hardware circuitry and software.

In various embodiments, computer system 100 can be connected to one or more other computer systems, like computer system 100, across a network to form a networked system. The network can include a private network or a public network such as the Internet. In the networked system, one or more computer systems can store and serve the data to other computer systems. The one or more computer systems that store and serve the data can be referred to as servers or the cloud, in a cloud computing scenario. The one or more computer systems can include one or more web servers, for example. The other computer systems that send and receive data to and from the servers or the cloud can be referred to as client or cloud devices, for example.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media or computer program products include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software, but the present teachings may be implemented as a combination of hardware and software or in hardware alone. The present teachings may be implemented with both object-oriented and non-object-oriented programming systems.

Pseudopotential Ion Accumulation and Charge Reduction

As described above, ExD techniques, such as ECD, are particularly well suited for analyzing proteins and peptides. However, some product ions produced by ECD with high charge states (>15+) and with m/z values very close to their precursor ions can have m/z values that overlap with each other. Because these different product ions have almost the same m/z values, they are difficult (or almost impossible) to detect mass selectively.

One method of reducing the m/z overlap of ions is to reduce their charge. Reducing the charge of an ion increases its m/z value. Reducing the charge of two ions with similar m/z values can move these ions to higher m/z values that have little or no overlap.

It is well-known that an ion/molecule or ion/ion proton-transfer reaction (PTR) can be used to reduce the charge state of the ions. However, in some pure PTR experiments, large fragments have been lost because such charge reduced fragments (with very large m/z) were moved out of the mass range of the mass analyzer used.

The McLuckey Paper provides one method of limiting the PTR applied to ions to a specific m/z value. In this method, an ion/ion proton transfer reaction (PTR) is inhibited at a selected charge state or m/z value by applying a resonance excitation voltage to the endcap electrodes of a quadrupole ion trap. Unfortunately, this approach requires complex parameter settings, can cause ions to fragment, and can cause saturation problems due to the pulsed release of charge reduced ions.

In various embodiments, products ions are accumulated at a reduced charge state in the dissociation device just after fragmentation without using resonance excitation. Instead, an additional alternating current (AC) voltage is applied to all the rods of the dissociation device-or to an exit aperture or lens of the dissociation device to create a pseudopotential voltage barrier over which only charge reduced product ions that have reached a certain m/z value can be transmitted.

In the McLuckey Paper, the additional AC resonance excitation applied to the ion trap is given a frequency corresponding to the m/z value at which charge reduction is inhibited. This frequency causes ions at this m/z value to be excited with a higher kinetic energy preventing them from reacting with the charge reducing reagent. Unfortunately, this higher kinetic energy can also cause these ions to fragment.

In contrast, the additional AC voltage applied to the entire rod electrodes in the reaction device, in various embodiments, creates a pseudopotential barrier that prevents product ions with m/z values below a threshold m/z value from moving outside of the dissociation device. This allows them to continue to react with the charge reducing reagent. The amplitude of the additional AC voltage is proportional to the square root of the threshold m/z value, for example. As a result, lowering the amplitude of the AC voltage lowers the threshold m/z value. In the case of peak parking applied to the linear RFQ, the AC voltage is applied in radial direction to excite the secular frequency of a charge reduced species.

In contrast, in various embodiments, the AC voltage is applied in the axial direction, which does not induce resonant excitation in the radial direction. This produces a potential barrier between the rods at the exit of the dissociation cell. There are, at least, two options to apply the AC voltage to dissociation cell. One is that the AC voltage is applied on the rods of the dissociation cell to apply the AC field between the dissociation cell rod set and the lens electrode placed at the exit of the dissociation cell (or exit lens electrode). Another option is that the AC voltage is applied at the exit lens electrode. To generate mass selective threshold, DC bias is applied between the exit lens and the dissociation cell. For positively charged precursor ions, the exit lens is set negatively relative to the dissociation cell. For negatively charged precursor ions, the exit lens is set at positively relative to the dissociation cell.

In a quadrupole dissociation device, for example, appropriate radio frequency (RF) voltages are applied to opposed pairs of electrodes within the dissociation device in order to confine ions radially. In various embodiments, the additional AC voltage is superimposed over the RF voltage in order to produce a pseudopotential barrier. Background information about pseudopotentials can be found in Gerlich, RF Ion Guides, in "The Encyclopedia of Mass Spectrometry," Vol 1, 182-194 (2003), which is incorporated herein by reference.

U.S. Pat. No. 7,456,388 (hereinafter the "'388 Patent") issued on Nov. 25, 2008, and incorporated herein by reference, for example, describes an ion guide for concentrating ion packets. The '388 Patent provides apparatus and methods that allow, for example, analysis of ions over broad m/z ranges with virtually no transmission losses. The ejection of ions from an ion guide is affected by creating conditions where all ions (regardless of m/z) may be made to arrive at a designated point in space, such as for example an extraction region or accelerator of a time-of-flight (TOF) mass analyzer, in a desired sequence or at a desired time and with roughly the same energy. Ions bunched in such a way can then be manipulated as a group, for example, by being extracted using a TOF extraction pulse and propelled along a desired path in order to arrive at the same spot on a TOF detector.

In order to eject ions from an ion guide so that all ions arrive at a desired location, at a desired time, and with roughly the same energy, the '388 Patent applies an additional AC voltage to the ion guide. This additional AC voltage creates a pseudopotential barrier. In the '388 Patent, the amplitude of the AC voltage is first set to allow only the ejection of the ions with the largest m/z value. Then, the amplitude of the AC voltage is gradually reduced in steps to change the depth of the pseudopotential well and allow ions with smaller and smaller m/z values to be ejected from the ion guide. In other words, in the '388 Patent, the AC voltage amplitude is scanned.

In various embodiments, the AC voltage applied to the dissociation device is not scanned. One AC voltage amplitude is set to correspond to the m/z threshold. In addition, the AC voltage is not used to sequentially eject ions of different m/z values. Instead, the AC voltage is used to create a barrier over which ions that reach the threshold m/z value after charge reduction due to a PTR are continuously ejected.

Figure 3:
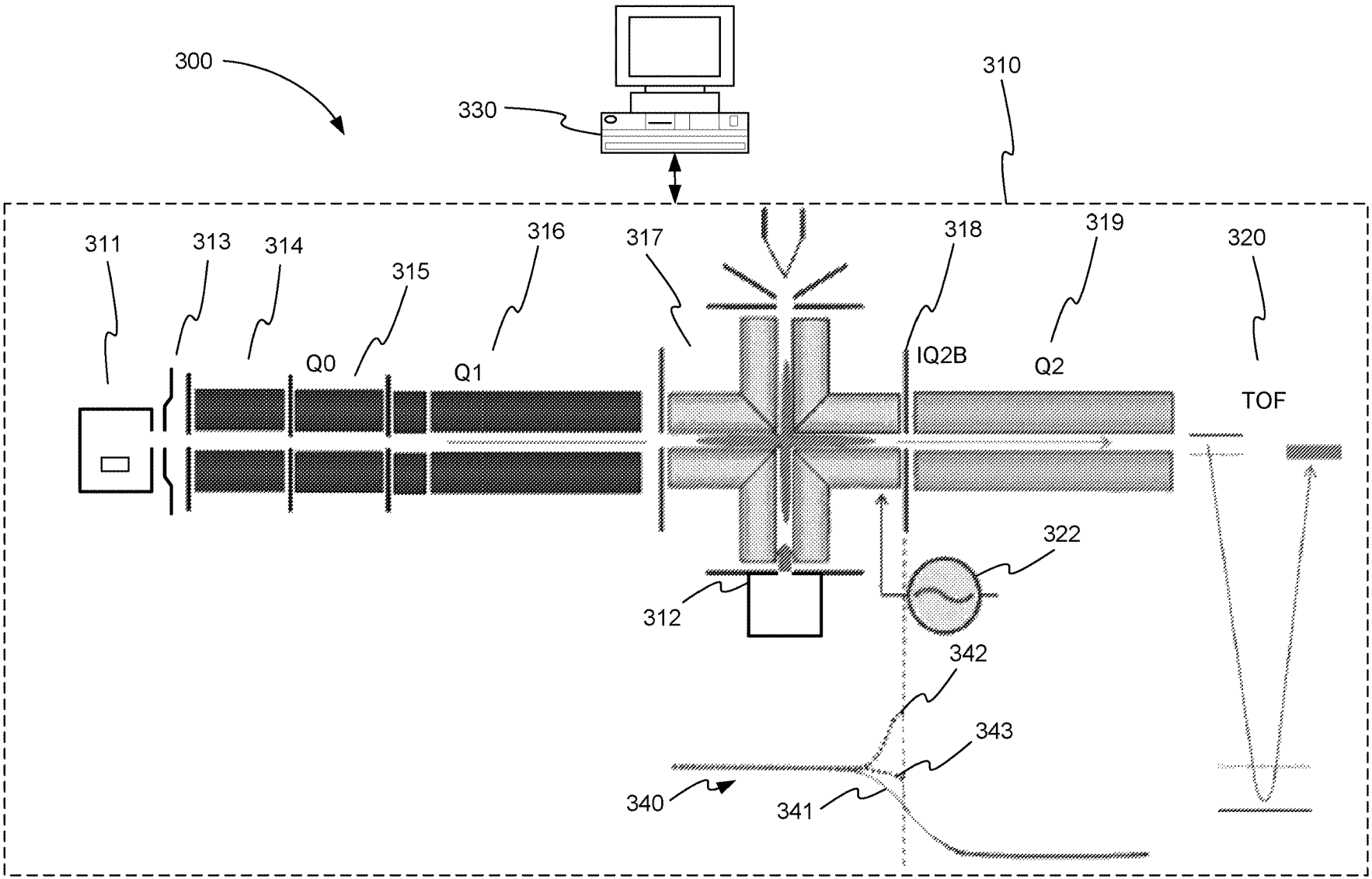
FIG. 3 is a schematic diagram of apparatus for reducing the charge of at least two product ions in order to move the mass-to-charge ratio (m/z) values of the at least two product ions above a threshold m/z value and decrease overlap among the m/z values of the at least two product ions before mass analysis where sample ions and reagent are received through different ports simultaneously, in accordance with various embodiments.

FIG. 3 is a schematic diagram 300 of apparatus for reducing the charge of at least two product ions in order to move the m/z values of the at least two product ions above a threshold m/z value and decrease overlap among the m/z values of the at least two product ions before mass analysis where sample ions and reagent are received through different ports simultaneously, in accordance with various embodiments. The apparatus of FIG. 3 includes reagent source device 312, Q1 mass filter device 316, and dissociation device 317. The apparatus is part of mass spectrometer 310, for example.

Ion source device 311 ionizes a compound of a sample, producing an ion beam of precursor ions with different m/z values. The ion beam is received by Q1 mass filter device 316 through orifice and skimmer 313, ion guide 314, and Q0 ion guide 315, for example.

Ion source device 311 can be, but is not limited to, an electrospray ion source (ESI) device, an electron impact source and a fast atom bombardment source device, a chemical ionization (CI) source device such as an atmospheric pressure chemical ionization source (APCI) device, atmospheric pressure photoionization (APPI) source device, or a matrix-assisted laser desorption source (MALDI) device.

Reagent source device 312 supplies charge reducing reagent. The charge reducing reagent can be charged ions.

Q1 mass filter device 316 selects a precursor ion of the compound of the sample from the ion beam and transmits the precursor ion to dissociation device 317.

Dissociation device 317 fragments the selected precursor ion, producing a plurality of product ions in dissociation device 317. Dissociation device 317 applies an AC voltage and a DC voltage to one or more of its electrodes that creates a pseudopotential in the axial direction to trap product ions of the plurality of product ions with m/z values below a threshold m/z in dissociation device 317. Dissociation device 317 receives the charge reducing reagent from the reagent source device 312. The charge reducing reagent and the AC voltage cause the trapped product ions to be charge reduced so that m/z values of at least two product ions of the trapped product ions increase to m/z values above the threshold m/z. Dissociation device 317 applies the DC voltage to its one or more electrodes relative to a DC voltage applied to electrodes of the next device that causes the at least two product ions with m/z values increased above the threshold m/z to be continuously transmitted to the next device. The next device, for example, is Q2 dissociation device 319 positioned after dissociation device 317. Q2 dissociation device 319 transmits the at least two product ions with m/z values increased above the threshold m/z to mass analyzer device 320 for mass analysis, for example.

In FIG. 3, reagent source device 312 is coupled to dissociation device 317. Dissociation device 317 is, for example, a Chimera device. A Chimera device includes eight L-shaped electrodes providing four branches. One aligned pair of branches receives a precursor ion from Q1 mass filter device 316. Another aligned pair of branches receives the PTR reagent from reagent source device 312.

Figure 4:
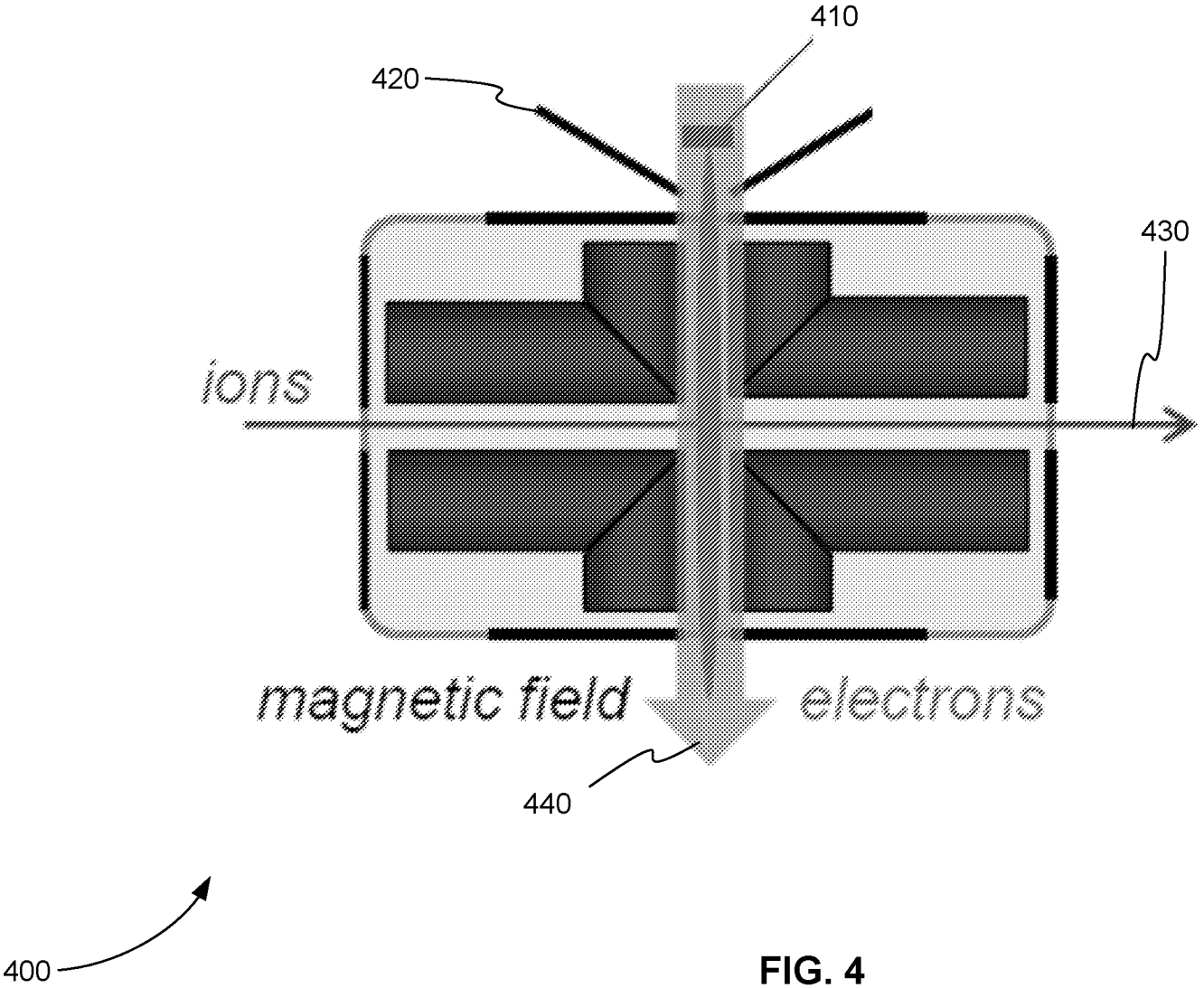
FIG. 4 is a schematic diagram of a Chimera device configured as an electron capture dissociation (ECD) dissociation device, in accordance with various embodiments.

FIG. 4 is a schematic diagram 400 of a Chimera device configured as an ECD device, in accordance with various embodiments. The Chimera device includes electron emitter or filament 410 and electron gate 420. Electrons are emitted perpendicular to the flow of ions 430 and parallel to the direction of magnetic field 440.

Returning to FIG. 3, mass spectrometers that include an ExD or UVPD dissociation device 317, typically include another dissociation device, like Q2 dissociation device for CID 319. Q2 dissociation device 319 is used to fragment compounds other than proteins or peptides, for example. During the analysis of proteins or peptides, Q2 dissociation device 319 acts as an ion guide and simply transmits product ions from dissociation device 317 to mass analyzer device 320.

Figure 5:
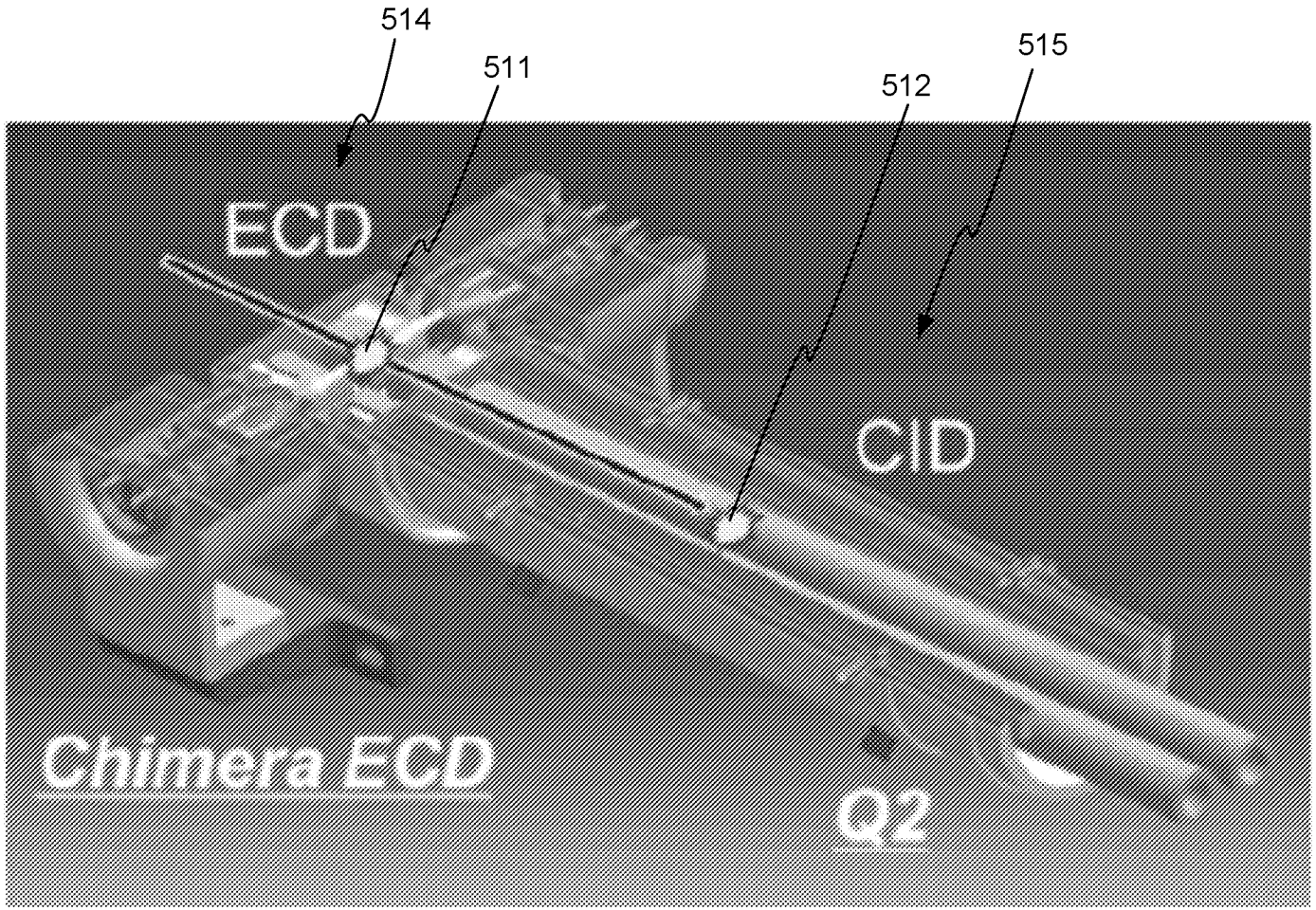
FIG. 5 is a cutaway three-dimensional perspective view of a Chimera ECD dissociation device and collision-induced dissociation (CID) cell, in accordance with various embodiments.

FIG. 5 is a cutaway three-dimensional perspective view 500 of a Chimera ECD and CID collision cell, in accordance with various embodiments. FIG. 5 shows that fragmentation of analyte ions selectively can be performed at location 511 in Chimera ECD 514 or at location 512 in CID collision cell 515.

Returning to FIG. 3, the PTR reagent is supplied to dissociation device 317 in order to reduce the charge state of at least two product ions with overlapping m/z values. Without some trapping force, however, the at least two product ions would simply pass through dissociation device 317. In order to trap the at least two product ions in dissociation device 317, an AC voltage is applied to all the rods of dissociation device 317 using AC voltage source 322, for example. In various alternative embodiments, the AC voltage is applied to an electrode of exit aperture or IQ2B lens 318. As described above, the AC voltage produces a pseudopotential experienced by the at least two product ions.

Plot 340 depicts the potentials experienced by different product ions at different locations in mass spectrometer 310. For example, line 341 depicts the DC potential all product ions experience between dissociation device 317 and Q2 dissociation device 319. Line 342 depicts the combined AC and DC (pseudo) potential that a product ion with an m/z value below the threshold m/z value experiences. Line 342 shows that there is a barrier preventing these ions from moving to Q2 dissociation device 319.

Line 343 depicts the combined AC and DC (pseudo) potential that a product ion with an m/z value above the threshold m/z value experiences. Line 343 shows that there is no barrier preventing these ions from moving to Q2 dissociation device 319.

Plot 340 shows that although the AC voltage traps product ions with m/z values below the threshold m/z value, it also allows product ions with m/z values above the threshold m/z value to move continuously to Q2 dissociation device 319. Because the AC voltage traps product ions with m/z values below the threshold m/z value and dissociation device 317 is supplied with PTR reagent, these trapped product ions are charge reduced by the PTR reagent until their m/z values increase above the threshold m/z. In this way, the AC voltage is limiting the PTR.

The PTR reagent can include negatively charged ions, for example. In this case, the AC voltage can mutually trap the PTR reagent ions.

DC potential 341 in plot 340 is created, for example, by setting the DC voltage of exit aperture or IQ2B lens 318 lower than the DC voltage of the rods of dissociation device 317. In addition, the DC voltage of Q2 dissociation device 319 is set lower than the DC voltage of the rods of dissociation device 317. By coupling the DC voltages and the pseudopotential produced by the AC voltage near exit aperture or IQ2B lens 318, dissociation device 317 performs high m/z filter extraction.

Due to the PTR, charge states of the product ions in dissociation device 317 are continuously decreasing and their m/z values are increasing. When the m/z value of the product ions reaches the high m/z extraction threshold, the ions are extracted from dissociation device 317. Because there is no PTR reagent outside of dissociation device 317, further charge reduction is stopped. FIG. 6 an exemplary hypothetical table 600 showing hypothetically the m/z values for 12 different product ions of myoglobin at difference charge states, in accordance with various embodiments. In FIG. 6, each column represents a different product ion, and the rows of each column show the hypothetical m/z values for that product ion at different charge states. The 12 different product ions with charge states ranging from +21 to +10 initially all have an m/z value of 809.5238. As a result, all 12 product ions initially have overlapping m/z values.

If, however, all 12 product ions are charge reduced until their m/z values increase to a level above an m/z threshold of 1300, FIG. 6 shows that the overlap among all 12 product ions is reduced. For example, when the product ion in column 601 is charge reduced until its m/z value increase to a level above an m/z threshold of 1300, its charge decreases from +21 to +13, and its m/z value increases from 809.5238 to 1307.692. When the product ion in column 602 is similarly charge reduced, its charge decreases from +20 to +12, and its m/z value increases from 809.5238 to 1349.206. As a result, the product ion in column 601 and the product ion in column 602 no longer overlap in m/z values.

Even at an m/z threshold of 1300, some product ions still overlap. For example, the product ions in columns 602, 607, and 612 still have the same m/z value of 1349.206. As a result, in order to separate more of the 12 product ions, the m/z threshold would need to be higher. However, setting the m/z threshold too high can raise the m/z value of some ions to a level too high for mass analysis. In other words, the separation of additional ions must be balanced against increasing the m/z threshold to too high a value.

Figure 7:
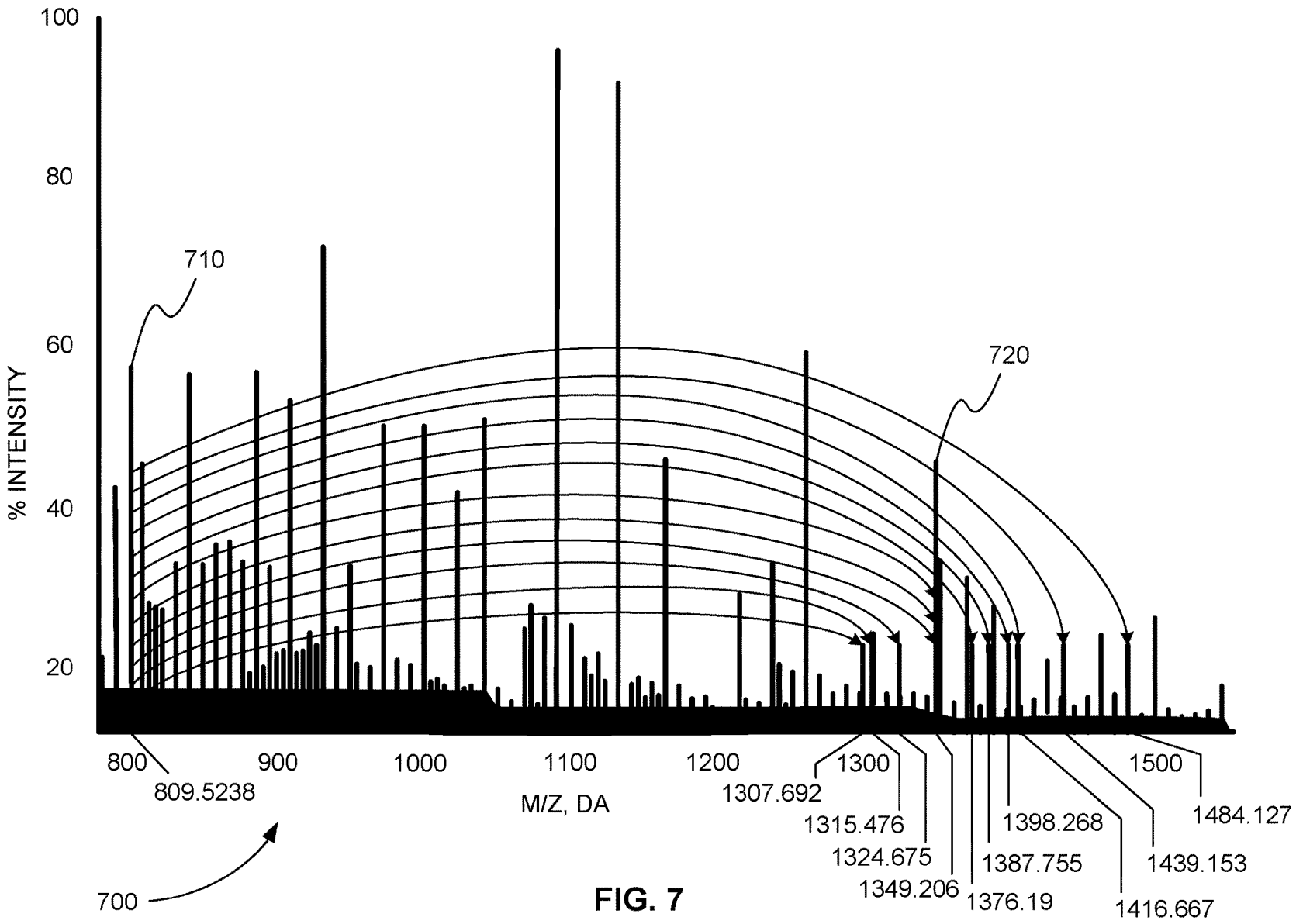
FIG. 7 is an exemplary hypothetical plot showing how the 12 product ions of FIG. 6 are moved from a single overlapping m/z value to 10 separate m/z values using an m/z threshold of 1300 and the apparatus of FIG. 3, in accordance with various embodiments.

FIG. 7 is an exemplary hypothetical plot 700 showing how the 12 product ions of FIG. 6 are moved from a single overlapping m/z value to 10 separate m/z values using an m/z threshold of 1300 and the apparatus of FIG. 3, in accordance with various embodiments. The 12 product ions of FIG. 6 are represented by peak 710 and all have an m/z of 809.5238. Using an m/z threshold of 1300 and the apparatus of FIG. 3, the m/z values of these product ions are moved to 10 separate m/z values 1307.692, 1315.476, 1324.675, 1349.206, 1376.19, 1387.755, 1398.268, 1416.667, 1439.153, 1484.127.

Three product ions still overlap at m/z value 1349.206 and are represented by peak 720. The m/z values of the other nine product ions, however, have been successfully separated and can be detected through mass analysis by mass analyzer 320 of FIG. 3, for example. The m/z threshold used can be a fixed value for all precursor ions, or can be set based on the precursor ions or compounds being analyzed. In a preferred embodiment, the m/z threshold is a fixed value such as 1300.

Figure 8:
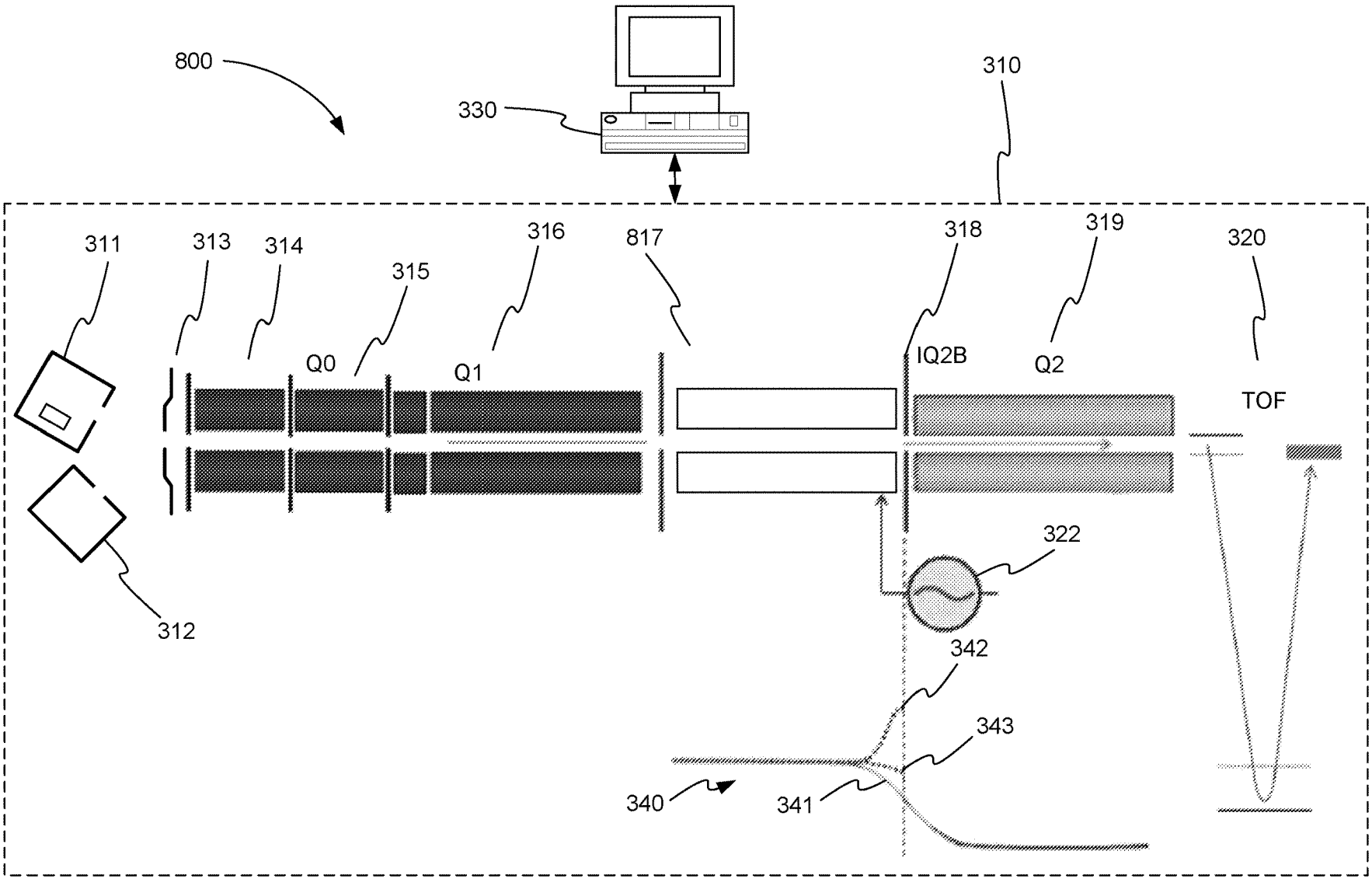
FIG. 8 is a schematic diagram of the apparatus of FIG. 3 where the dissociation device that receives sample ions and reagent through different ports simultaneously is replaced by a dissociation device that receives sample ions and reagent separately through the same port, in accordance with various embodiments.

FIG. 8 is a schematic diagram 800 of the apparatus of FIG. 3 where the dissociation device that receives sample ions and reagent through different ports simultaneously is replaced by a dissociation device that receives sample ions and reagent separately through the same port, in accordance with various embodiments. Specifically, the Chimera ECD dissociation device 317 of FIG. 3 is replaced by a multi-pole dissociation device 817 in FIG. 8. Multi-pole dissociation device 815 can be, but is not limited to, a quadrupole, hexapole, or octupole and can perform ETD or UVPD, for example, by introducing ETD reagents or UV laser beam parallel to the dissociation device 815.

Q1 mass filter device 316 and ETD and PTR reagent source device 312 now transmit their precursor ions and reagent, respectively, to dissociation device 815 through a single entrance port of dissociation device 815. For example, ion source device 311 and reagent source device 312 now transmit their sample ions and reagent, respectively, to dissociation device 815 through a single entrance port of dissociation device 815. The sample ions and reagent are transmitted through orifice and skimmer 313 and ion guide 314. For example, first, the sample ions are transmitted to dissociation device 815. Then, ion source device 311 is stopped and reagent source device 312 is opened to transmit ETD reagent to dissociation device 815 by selecting ETD reagent ions by the Q1 filter. Then, reagent source device 312 is keep opening to transmit charge reducing reagent to dissociation device 815 by selecting charge reducing reagent ions by the Q1 filter. In various embodiments, charge reducing reagent is introduced through orifice and skimmer 313 and ion guide 314 by reagent source device 312 when negative chemical ionization is used at atmospheric pressure.

Pseudopotential Trapping and Charge Reducing Apparatus

Returning to FIG. 3, mass spectrometer 310 includes apparatus for reducing the charge of at least two product ions in order to move the m/z values of the at least two product ions above a threshold m/z value and decrease overlap among the m/z values of the at least two product ions before mass analysis. This apparatus includes reagent source device 312 and dissociation device 317.

Reagent source device 312 supplies charge reducing reagent. The charge reducing reagent can be charged ions.

Q1 mass filter device 316 selects and transmits a precursor ion of a compound of a sample from an ion beam. Q1 mass filter device 316 is shown as quadrupole. However, Q1 mass filter device 316 can be any type of mass filter, such as a magnetic sector mass analyzer.

Dissociation device 317 receives a precursor ion and fragments the selected precursor ion, producing a plurality of product ions in dissociation device 317. For example, dissociation device 317 receives the precursor ion from Q1 mass filter device 316. Dissociation device 317 fragments the selected precursor ion using ExD, IRMPD, CID, or UVPD, for example.

Dissociation device 317 receives the charge reducing reagent from reagent source device 312. Dissociation device 317 applies an AC voltage and a DC voltage to one or more electrodes of dissociation device 317 that creates a pseudopotential in the axial direction to trap product ions of the plurality of product ions with m/z values below a threshold m/z in dissociation device 317. The AC voltage, in turn, causes the trapped product ions to be charge reduced by the received charge reducing reagent so that m/z values of at least two product ions of the trapped product ions increase to m/z values above the threshold m/z. Dissociation device 317 applies the DC voltage to its one or more electrodes relative to a DC voltage applied to electrodes of a next device positioned after dissociation device 317 that causes the at least two product ions with m/z values increased above the threshold m/z to be continuously transmitted to the next device.

In various alternative embodiments, reagent source device 312 is a PTR reagent source device. The charge reducing reagent includes PTR reagent ions. In addition, dissociation device 317 applies the AC voltage to mutually trap both the plurality of product ions and the received PTR reagent ions.

In various embodiments, the one or more electrodes of dissociation device 317 are the rods of dissociation device 317. In various alternative embodiments, the one or more electrodes of dissociation device 317 include exit aperture or IQ2B lens 318 of dissociation device 317.

Returning to FIG. 8, in various embodiments, the precursor ion and the charge reducing reagent from reagent source device 312 are received separately and sequentially by the same entrance of dissociation device 817. Dissociation device 817 can be, but is not limited to, a quadrupole, hexapole, or octupole dissociation device.

Returning to FIG. 3, in various embodiments, the precursor ion and the charge reducing reagent from reagent source device 312 are received at different entrances of dissociation device 317.

In a preferred embodiment, dissociation device 317 is a Chimera ECD device. This device includes eight L-shaped electrodes, providing four branches. One aligned pair of branches receives the selected precursor ion from Q1 mass filter source device 316. Another aligned pair of branches receives the charge reducing reagent from reagent source device 312. To perform ExD, electron beam is introduced from one of the aligned pairs of branches. To perform UPVD, UV laser beam is introduced from one of the aligned pairs of branches.

In various embodiments, the next device is Q2 dissociation device 319, wherein dissociation device 317 applies a DC voltage to its one or more electrodes relative to a DC voltage applied to electrodes of Q2 dissociation device 319 that causes the at least two product ions with m/z values increased above the threshold m/z to be continuously transmitted to Q2 dissociation device 319.

In various embodiments, mass analyzer device 320 is positioned after Q2 dissociation device 319. Mass analyzer device 320 measures m/z values of the at least two product ions with m/z values increased above the threshold m/z. Mass analyzer device 320 can include, but is not limited to, a time-of-flight (TOF) mass analyzer, a quadrupole, an ion trap, a linear ion trap, an orbitrap, a magnetic sector mass analyzer, a hybrid quadrupole time-of-flight (Q-TOF) mass analyzer, or a Fourier transform ion cyclotron resonance mass analyzer. In a preferred embodiment, mass analyzer 310 is a TOF mass analyzer.

In various embodiments, processor 330 is used to control or provide instructions to reagent source device 312, Q1 mass filter device 316, and dissociation device 317 and to analyze data collected. Processor 330 controls or provides instructions by, for example, controlling one or more voltage, current, or pressure sources (not shown). Processor 330 can be a separate device as shown in FIG. 3 or can be a processor or controller of one or more devices of mass spectrometer 310. Processor 330 can be, but is not limited to, a controller, a computer, a microprocessor, the computer system of FIG. 1, or any device capable of sending and receiving control signals and data.

Method for Pseudopotential Trapping and Charge Reduction

Figure 9:
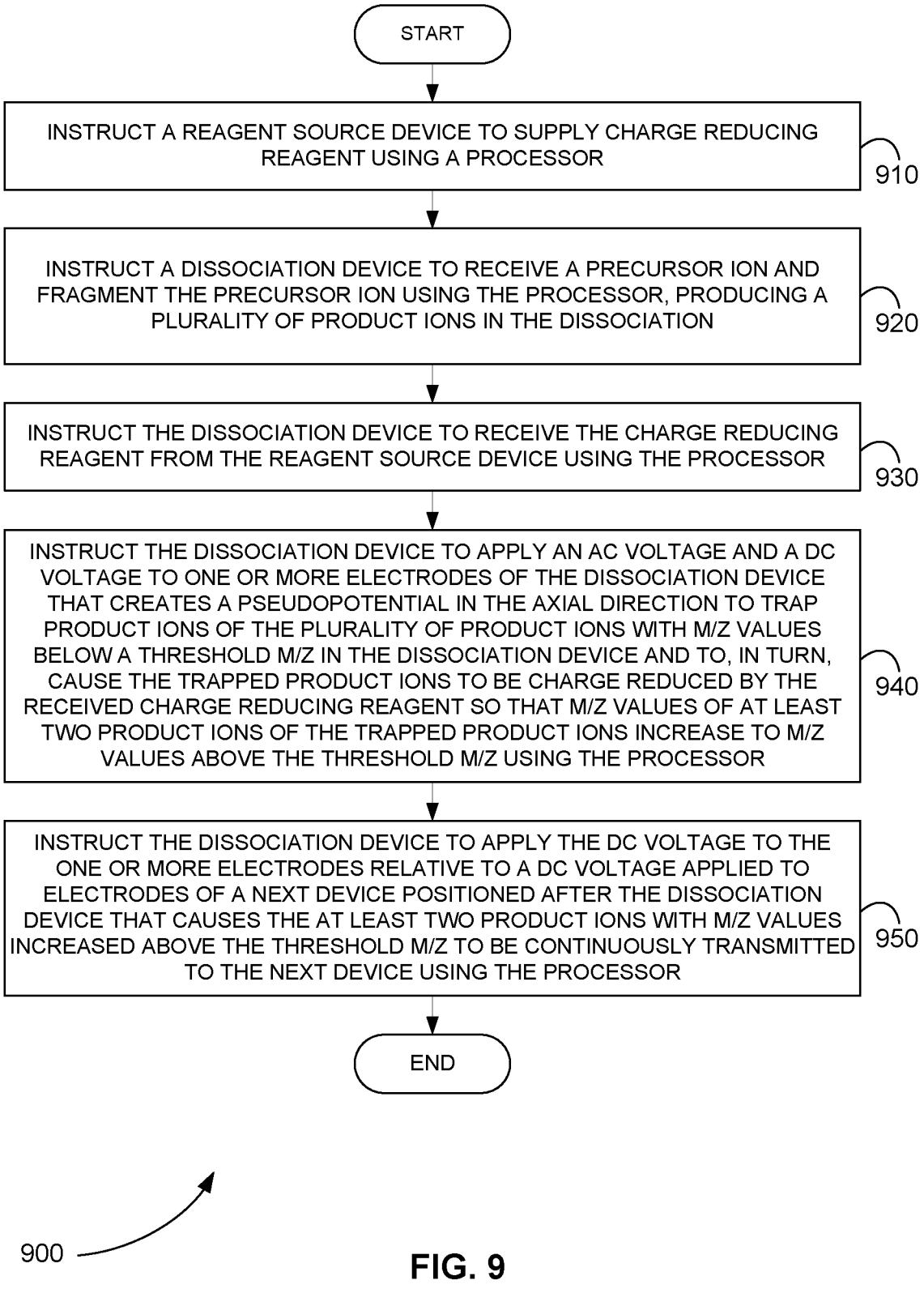
FIG. 9 is a flowchart showing a method for reducing the charge of at least two product ions in order to move the m/z values of the at least two product ions above a threshold m/z value and decrease overlap among the m/z values of the at least two product ions before mass analysis, in accordance with various embodiments.

FIG. 9 is a flowchart showing a method 900 for reducing the charge of at least two product ions in order to move the m/z values of the at least two product ions above a threshold m/z value and decrease overlap among the m/z values of the at least two product ions before mass analysis, in accordance with various embodiments.

In step 910 of method 900, a reagent source device is instructed to supply charge reducing reagent using a processor.

In step 920, a dissociation device is instructed to receive a precursor ion and fragment the precursor ion using the processor, producing a plurality of product ions in the dissociation.

In step 930, the dissociation device is instructed to receive the charge reducing reagent from the reagent source device using the processor.

In step 940, the dissociation device is instructed to apply an AC voltage and a DC voltage to one or more electrodes of the dissociation device that creates a pseudopotential in the axial direction to trap product ions of the plurality of product ions with m/z values below a threshold m/z in the dissociation device using the processor. This, in turn, causes the trapped product ions to be charge reduced by the received charge reducing reagent so that m/z values of at least two product ions of the trapped product ions increase to m/z values above the threshold m/z.

In step 950, the dissociation device is instructed to apply the DC voltage to the one or more electrodes relative to a DC voltage applied to electrodes of a next device positioned after the dissociation device that causes the at least two product ions with m/z values increased above the threshold m/z to be continuously transmitted to the next device using the processor.

Computer Program Product for Pseudopotential Trapping and Charge Reduction

In various embodiments, computer program products include a tangible computer-readable storage medium whose contents include a program with instructions being executed on a processor so as to perform a method for reducing the charge of at least two product ions in order to move the m/z values of the at least two product ions above a threshold m/z value and decrease overlap among the m/z values of the at least two product ions before mass analysis. This method is performed by a system that includes one or more distinct software modules.

Figure 10:
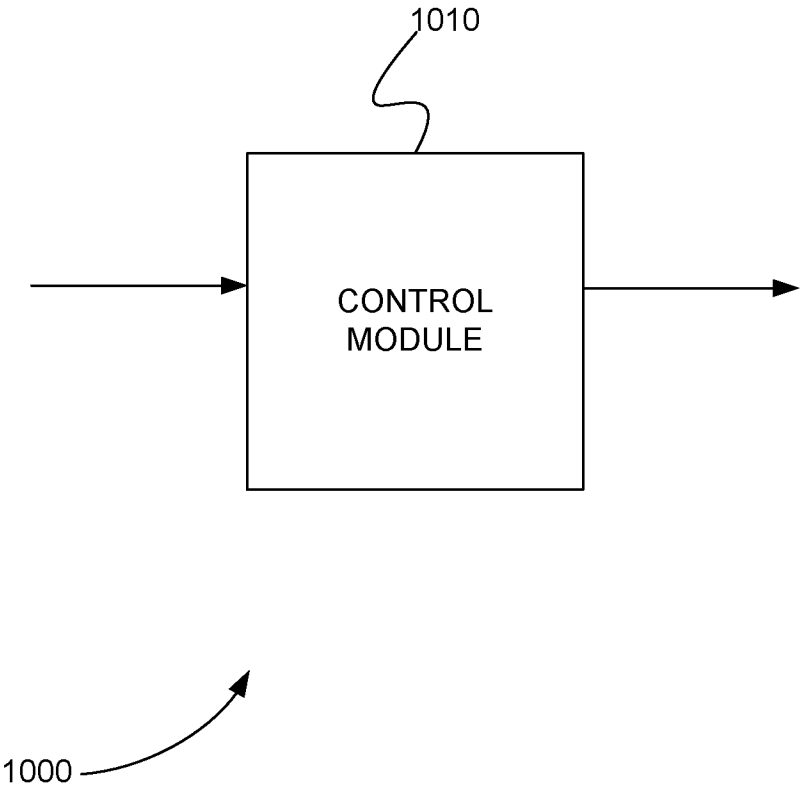
FIG. 10 is a schematic diagram of a system that includes one or more distinct software modules that performs a method for reducing the charge of at least two product ions in order to move the m/z values of the at least two product ions above a threshold m/z value and decrease overlap among the m/z values of the at least two product ions before mass analysis, in accordance with various embodiments.

FIG. 10 is a schematic diagram of a system 1000 that includes one or more distinct software modules that performs a method for reducing the charge of at least two product ions in order to move the m/z values of the at least two product ions above a threshold m/z value and decrease overlap among the m/z values of the at least two product ions before mass analysis, in accordance with various embodiments. System 1000 includes control module 1010.

Control module 1010 instructs a reagent source device to supply charge reducing reagent. Control module 1010 instructs a dissociation device positioned to receive a precursor ion and fragment the precursor ion, producing a plurality of product ions in the dissociation.

Control module 1010 instructs the dissociation device to receive the charge reducing reagent from the reagent source device. Control module 1010 instructs the dissociation device to apply an AC voltage and a DC voltage to one or more electrodes of the dissociation device that creates a pseudopotential in the axial direction to trap product ions of the plurality of product ions with m/z values below a threshold m/z in the dissociation device. This, in turn, causes the trapped product ions to be charge reduced by the received charge reducing reagent so that m/z values of at least two product ions of the trapped product ions increase to m/z values above the threshold m/z. Control module 1010 instructs the dissociation device to apply the DC voltage to the one or more electrodes relative to a DC voltage applied to electrodes of a next device positioned after the dissociation device that causes the at least two product ions with m/z values increased above the threshold m/z to be continuously transmitted to the next device.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. Apparatus for reducing the charge of at least two product ions in order to move the mass-to-charge ratio (m/z) values of the at least two product ions above a threshold m/z value and decrease overlap among the m/z values of the at least two product ions before mass analysis, comprising:

a reagent source device that supplies charge reducing reagent; and a dissociation device that receives a precursor ion, dissociates the precursor ion, producing a plurality of product ions in the dissociation device, receives the charge reducing reagent from the reagent source device, applies an alternating current (AC) voltage and a direct current (DC) voltage to one or more electrodes of the dissociation device that creates a pseudopotential in an axial direction to trap product ions of the plurality of product ions with m/z values below a threshold m/z in the dissociation device and to, in turn, cause the trapped product ions to be charge reduced by the received charge reducing reagent so that m/z values of at least two product ions of the trapped product ions increase to m/z values above the threshold m/z, and applies the DC voltage to the one or more electrodes relative to a DC voltage applied to electrodes of a next device positioned after the dissociation device that causes the at least two product ions with m/z values increased above the threshold m/z to be continuously transmitted to the next device.

2. The apparatus of claim 1, wherein the charge reducing reagent source device comprises a proton transfer reaction (PTR) reagent source device, the charge reducing reagent comprises PTR reagent ions, and the dissociation device applies the AC voltage to the one or more electrodes of the dissociation device that creates the pseudopotential to mutually trap both the plurality of product ions and the received PTR reagent ions with m/z values below the threshold m/z.

3. The apparatus of claim 1, wherein the one or more electrodes of the dissociation device comprise rods of the dissociation device.

4. The apparatus of claim 1, wherein the one or more electrodes of the dissociation device comprise an electrode of an exit aperture or lens of the dissociation device.

5. The apparatus of claim 1, wherein the precursor ion and the charge reducing reagent from the reagent source device are received separately and sequentially by a same entrance of the dissociation device.

6. The apparatus of claim 5, wherein the dissociation device comprises a quadrupole, hexapole, or octupole dissociation device.

7. The apparatus of claim 1, wherein the precursor ion and the charge reducing reagent from the reagent source device are received at different entrances of the dissociation device.

8. The apparatus of claim 7, wherein the dissociation device comprises a Chimera electron capture dissociation (ECD) device that includes eight L-shaped electrodes providing four branches, wherein one aligned pair of branches receives the selected precursor ion from a mass filter source device and simultaneously another aligned pair of branches receives the charge reducing reagent from the reagent source device.

9. The apparatus of claim 1, wherein the next device comprises a second dissociation device, wherein the dissociation device applies a DC voltage to the one or more electrodes of the dissociation device relative to a DC voltage applied to electrodes of the second dissociation device that causes the at least two product ions with m/z values increased above the threshold m/z to be continuously transmitted to the dissociation device.

10. The apparatus of claim 9, further comprising a mass analyzer device positioned after the second dissociation device, wherein the mass analyzer device measures m/z values of the at least two product ions with m/z values increased above the threshold m/z.

11. The apparatus of claim 1, wherein the next device comprises a mass analyzer device, wherein the dissociation device applies a DC voltage to the one or more electrodes of the dissociation device relative to a DC voltage applied to electrodes of the mass analyzer device that causes the at least two product ions with m/z values increased above the threshold m/z to be continuously transmitted to the mass analyzer device and wherein the mass analyzer device measures m/z values of the at least two product ions with m/z values increased above the threshold m/z.

12. The apparatus of claim 1, wherein the dissociation device comprises an electron capture dissociation ECD device.

13. The apparatus of claim 1, wherein the dissociation device comprises an electron transfer dissociation (ETD) device, an ultraviolet photodissociation (UVPD) device, an infrared photodissociation (IRMPD) device, or a collision-induced dissociation (CID) device.

14. A method for reducing the charge of at least two product ions in order to move the mass-to-charge ratio (m/z) values of the at least two product ions above a threshold m/z value and decrease overlap among the m/z values of the at least two product ions before mass analysis, comprising:

instructing a reagent source device to supply charge reducing reagent using a processor;

instructing a dissociation device to receive a precursor ion and fragment the precursor ion using the processor, producing a plurality of product ions in the dissociation device;

instructing the dissociation device to receive the charge reducing reagent from the reagent source device using the processor;

instructing the dissociation device to apply an alternating current (AC) voltage and a direct current (DC) voltage to one or more electrodes of the dissociation device that creates a pseudopotential in an axial direction to trap product ions of the plurality of product ions with m/z values below a threshold m/z in the dissociation device and to, in turn, cause the trapped product ions to be charge reduced by the received charge reducing reagent so that m/z values of at least two product ions of the trapped product ions increase to m/z values above the threshold m/z using the processor; and instructing the dissociation device to apply the DC voltage to the one or more electrodes relative to a DC voltage applied to electrodes of a next device positioned after the dissociation device that causes the at least two product ions with m/z values increased above the threshold m/z to be continuously transmitted to the next device using the processor.

15. A computer program product, comprising a non-transitory and tangible computer-readable storage medium whose contents include a program with instructions being executed on a processor so as to perform a method for reducing the charge of at least two product ions in order to move the mass-to-charge ratio (m/z) values of the at least two product ions above a threshold m/z value and decrease overlap among the m/z values of the at least two product ions before mass analysis, the method comprising:

providing a system, wherein the system comprises one or more distinct software modules, and wherein the distinct software modules comprise a control module;

instructing a reagent source device to supply charge reducing reagent using the control module;

instructing a dissociation device to receive a precursor ion and fragment the precursor ion using the control module, producing a plurality of product ions in the dissociation;

instructing the dissociation device to receive the charge reducing reagent from the reagent source device using the control module;

instructing the dissociation device to apply an alternating current (AC) voltage and a direct current (DC) voltage to one or more electrodes of the dissociation device that creates a pseudopotential in an axial direction to trap product ions of the plurality of product ions with m/z values below a threshold m/z in the dissociation device and to, in turn, cause the trapped product ions to be charge reduced by the received charge reducing reagent so that m/z values of at least two product ions of the trapped product ions increase to m/z values above the threshold m/z using the control module; and instructing the dissociation device to apply the DC voltage to the one or more electrodes relative to a DC voltage applied to electrodes of a next device positioned after the dissociation device that causes the at least two product ions with m/z values increased above the threshold m/z to be continuously transmitted to the next device using the control module.

* * * * *